US008321991B2

(12) United States Patent
Robideau

(10) Patent No.: US 8,321,991 B2
(45) Date of Patent: Dec. 4, 2012

(54) PRECISION CONTOURING TOOL

(76) Inventor: Terry David Robideau, Gresham, OR (US)

( * ) Notice: Subject to any disclaimer, the term of this patent is extended or adjusted under 35 U.S.C. 154(b) by 422 days.

(21) Appl. No.: 12/774,259

(22) Filed: May 5, 2010

(65) Prior Publication Data

US 2011/0271476 A1 Nov. 10, 2011

(51) Int. Cl.
*B05C 17/10* (2006.01)

(52) U.S. Cl. ..... 15/245.1

(58) Field of Classification Search ..... 15/104.011, 15/235.4, 235.5, 236.01, 236.07, 245.1
See application file for complete search history.

(56) References Cited

U.S. PATENT DOCUMENTS

2009/0100624 A1* 4/2009 MacCormick ..... 15/223
2010/0236003 A1* 9/2010 Teng ..... 15/105

* cited by examiner

*Primary Examiner* — Rachel Steitz
*Assistant Examiner* — Brianne Kalach
(74) *Attorney, Agent, or Firm* — Mark S. Hubert

(57) ABSTRACT

Cold rolled, annealed, blue tempered spring steel and high density polytetrafluoroethylene are combined and specifically gauged, sized, and edged to form a precision contouring tool capable of shaping, contouring, and controlling the movement of synthetic fillers on damaged auto body panels, resulting in a perfectly shaped repair. For application involving flat panels a stiffening bar is frictionally fitted to the precision contouring tool.

8 Claims, 5 Drawing Sheets

PRECISION CONTOURING TOOL

BACKGROUND OF THE INVENTION

The present invention relates generally to auto body tools. More particularly, the present invention relates to a precision contouring tool for the contouring and shaping of synthetic fillers to repair damaged body panels on vehicles.

In the past automobile body panels were constructed from heavy gauge metals, and often these panels were flat or nearly flat. Repairing a damaged panel was an iterative process in which a synthetic filler was applied in excess to the panel and then the excess material was cut away using a removal tool, such as a sander or rasping plane, and eventually transitioning to a fine grit sandpaper. It would not be unusual to miss a spot or realize there are some gaps or pits in the filling of the damage after the first application of filler. A new batch of filler would have to be applied and the process repeated until most of the filler was removed, resulting in smooth transition between the metal and filler.

Today, body panels are composed of light-weight metals, are extremely thin, and contain contoured body lines which extend over several panels appearing contiguous over the length of the automobile. When a panel is damaged, these thin, irregularly shaped panels, are extremely hard to fill accurately, often resulting in a "fix" that simply does not match the original contour. What was a painstaking process in the past is presently even more labor intensive, and typically reserved for auto body repair professionals.

SUMMARY OF THE INVENTION

In accordance with the invention, the countless hours of sanding to shape synthetic fillers that have been applied in excess to the damaged portion of an auto body panel is solved by a precision contouring tool that allows a minimal amount of pressure to be applied while controlling the movement and placement of the synthetic plastic filler during its contouring and shaping. The shaping and contouring of the filler occurs simultaneously thus requiring only a minimal amount of light sanding to finish.

DETAILED DESCRIPTION

Figure 10:
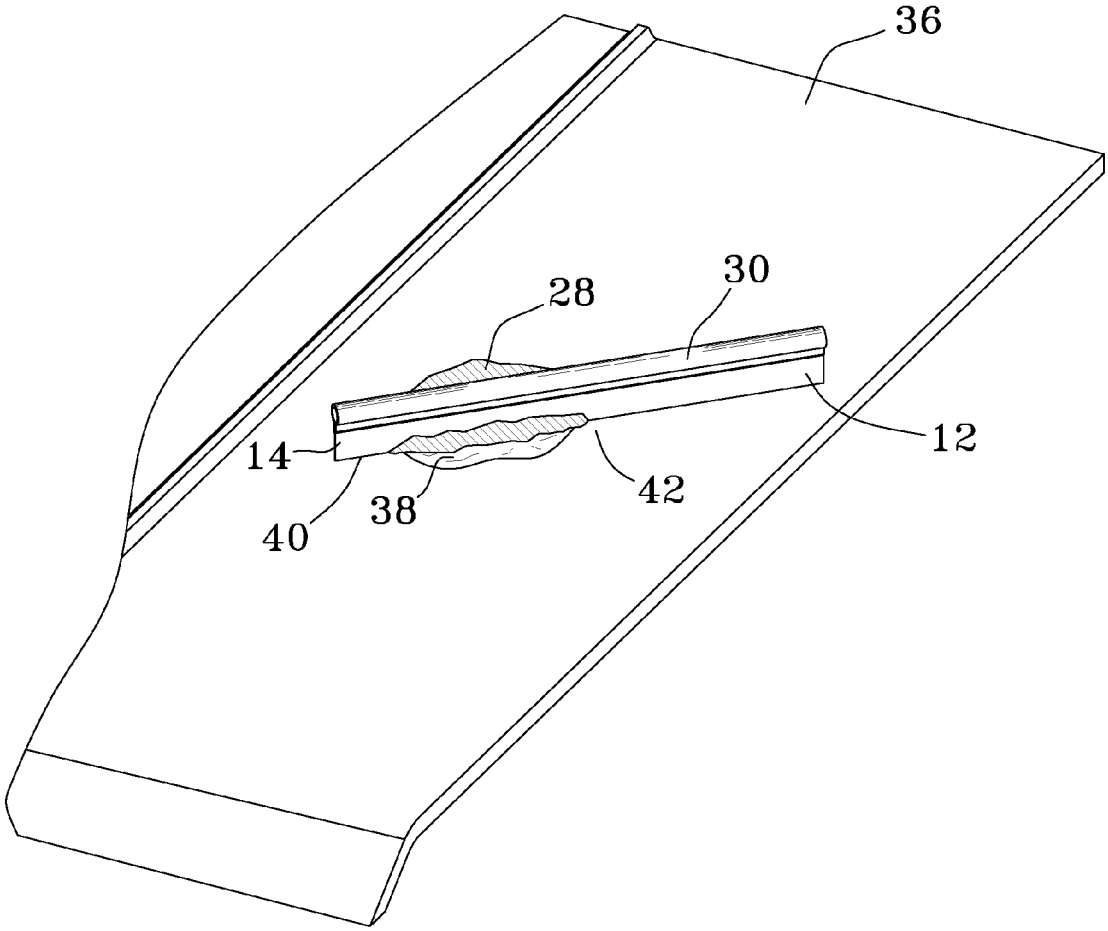
FIG. 10 illustrates the precision contouring tool, featuring a stiffening bar, contouring and shaping synthetic filler over a damaged portion of an auto body panel.

Referring now to FIGS. 1-4, the precision contouring tool 6 is illustrated. Tool 6 is planar with a first face 8, a second face 10, a proximate end 12, and a distal end 14. Tool 6 is generally rectangular in outline, with first edge 16, second edge 19, first end edge 21 and second end edge 23. All edges are square but can be rounded as illustrated in FIG. 10. Tool 6 is of uniform thickness (i.e. first face 8 and second face 10 are parallel). Tool 6 is made from the ASTM 1095 carbon steel family. The preferred embodiment is cold rolled, annealed, and blue tempered into a spring steel with a Rockwell hardness of HRC 48-51. It has the following specific chemical analysis:

| C | Mn | P | S | Si | Cr | Al |
|---|---|---|---|---|---|---|
| 1.010 | .420 | .008 | .002 | .180 | .385 | .007 |

Figure 1:
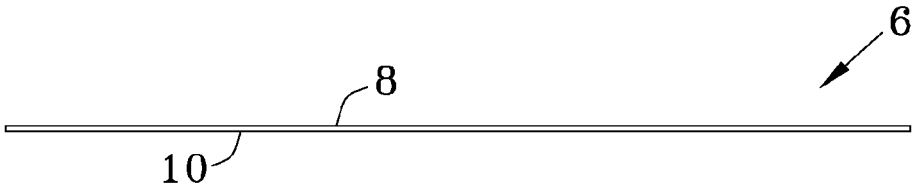
FIG. 1 is a front view of the precision contouring tool; it should be noted that the back view is identical to the front view.
Figure 2:
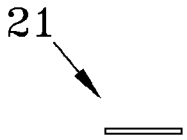
FIG. 2 is an end view of the precision contouring tool; both right and left end views are identical.
Figure 3:
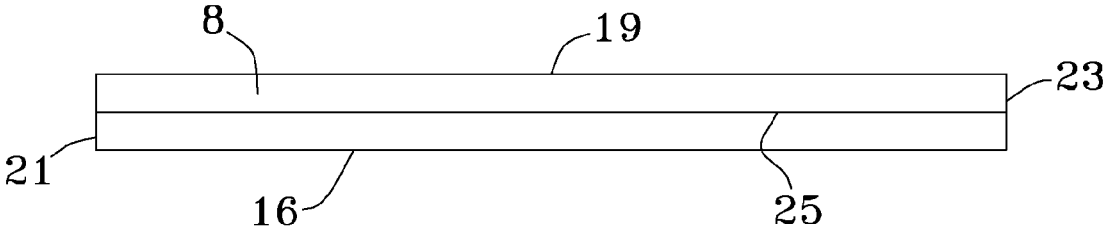
FIG. 3 is a top view of the precision contouring tool.
Figure 4:
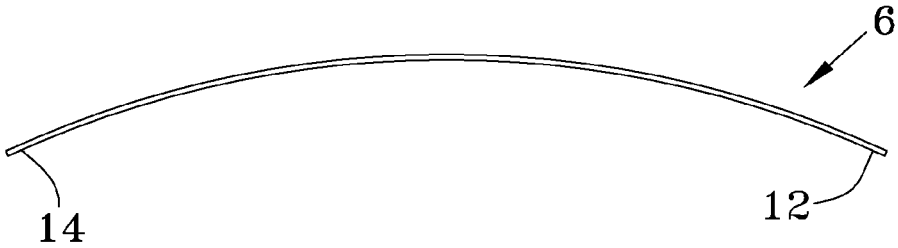
FIG. 4 is a front view of the precision contouring tool in a flexed state.

This specific composition and treatment along with the specific dimensions of length, width, and thickness, allow tool 6 to flex (elastically deform) as illustrated in FIG. 4, when pressure from a user's thumbs is simultaneously applied to proximate end 12 and distal end 14 of one face (either first face 8 or second face 10, since precision contouring tool 6, is reversible). The ability for tool 6 to flex is a necessity to achieving contour matching when contouring and shaping synthetic filler to a body panel. Tool 6 must be able to flex to form various, even radius curves with only minimal or moderate pressure so the required arc can be maintained evenly over an elongated surface area without any change. Tool 6 has the following dimensions (+/−5.0%): 0.062" thick, 2" wide, and 24" long and coated in a replaceable polytetrafluoroethylene (PTFE) single sided tape 18. Since the tool 6 will occasionally contact a jagged edge of a damaged panel the tape 18 will deform due to denting. However, small dents to tape 18 can actually be buffed or smoothed out by a plastic scouring pad. Should tape 18 tear, it can be easily replaced. Tape 18 is applied to spring steel 17 as a single sheet, which completely covers first edge 16 and second edge 19, forming a seam 25 along the longitudinal axis of tool 6 on either first face 8 or second face 10 as is visible in FIG. 6. The PTFE has the following properties (+/−2%):

| Thickness of tape (inches) | Adhesive Thickness (inches) | Adhesive Type | Tensile Strength (lbs/in) | Elongation % |
|---|---|---|---|---|
| 0.0122 | 0.0022 | Silicone | 33 | 250 |

Figure 5:
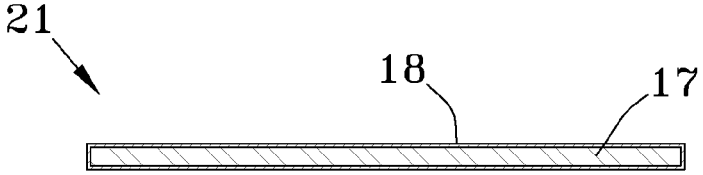
FIG. 5 is an enlarged cross-sectional end view of the precision contouring tool.

FIG. 5 is an enlarged cross-sectional end view of the precision contouring tool 6 in which the layer of PTFE tape 18 is visible over the spring steel 17. PTFE tape 18 provides a low friction/non-stick surface to contouring tool 6, in which the synthetic filler will not easily adhere.

Figure 6:
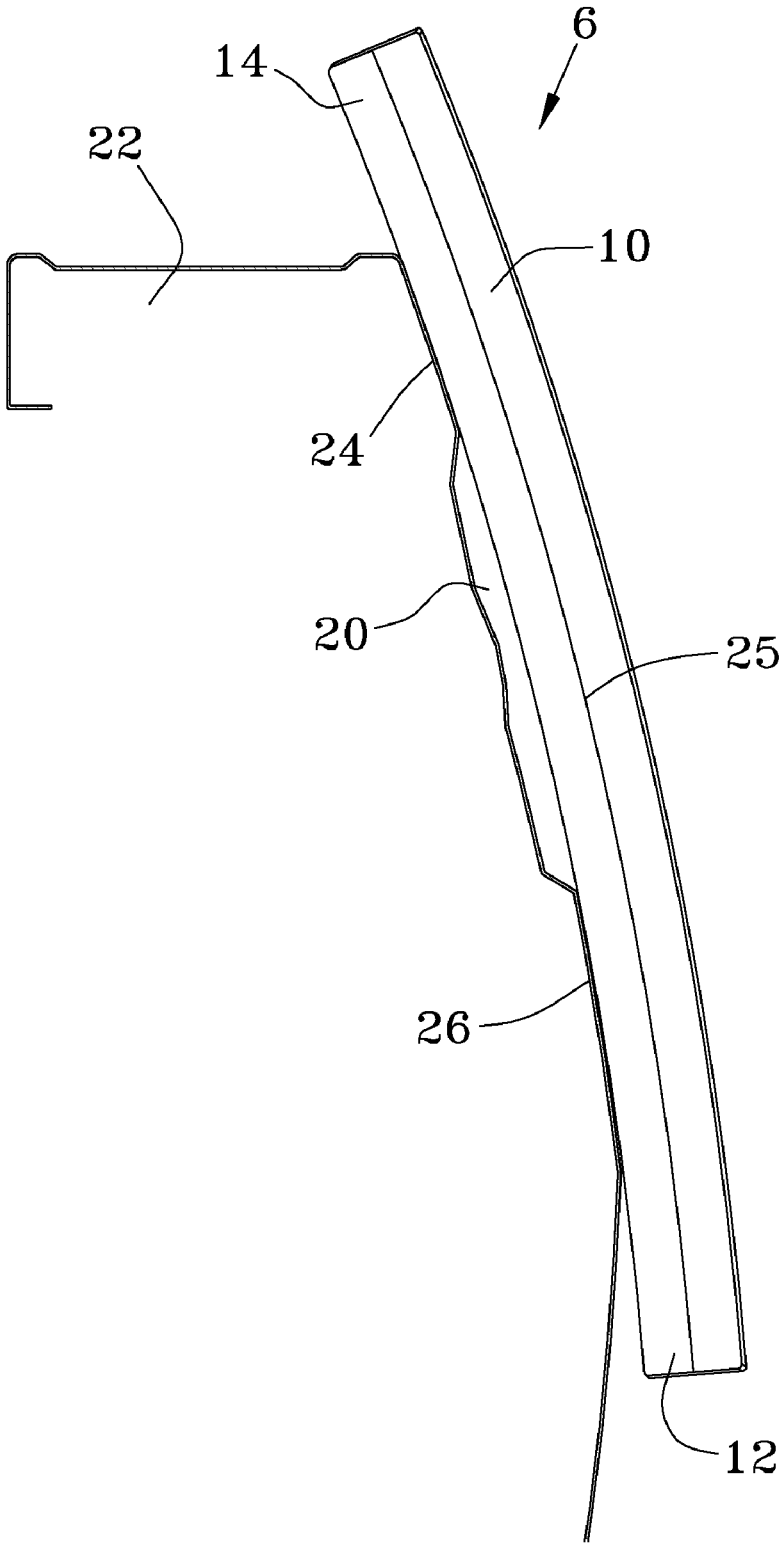
FIG. 6 illustrates the precision contouring tool bridging the damaged portion of an auto body panel.
Figure 7:
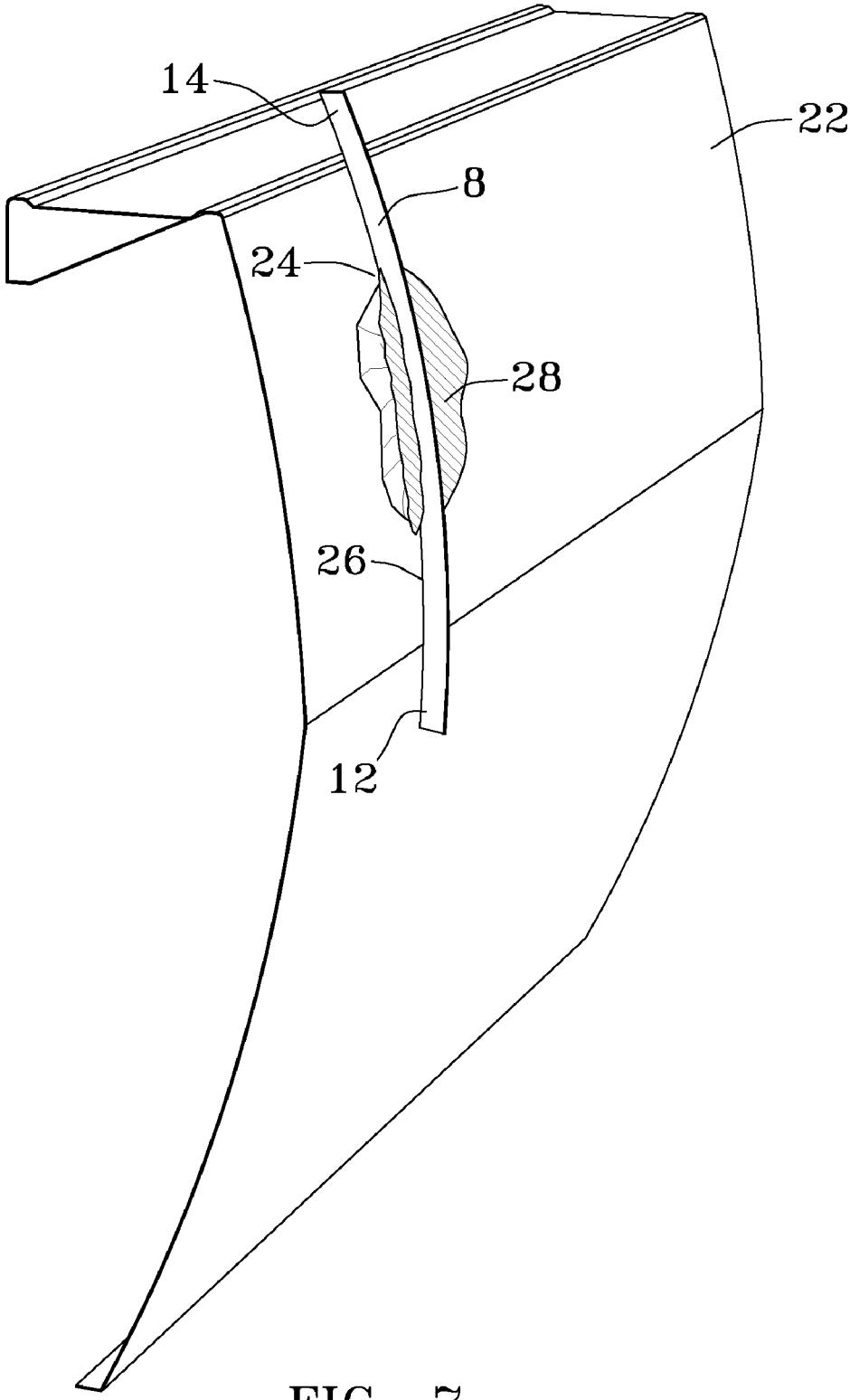
FIG. 7 illustrates the precision contouring tool in a flexed state contouring and shaping synthetic filler over a damaged portion of an auto body panel.

In operation, because of the flexibility of contouring tool 6, the tool bridges dent 20 with its proximate end 12 and distal end 14 remaining in contact with body panel 22 on a first side 24 of dent 20, and a second side 26 of dent 20 as can be seen in FIG. 6. The ability of contouring tool 6 to remain in contact with both sides 24 and 26 of dent 20 allows for the synthetic filler 28 to be contoured and shaped about to the damaged panel (i.e., dent 20). The contour on each side 24 and 26 is transferred along dent 20 as the synthetic filler 28 is contoured and shaped, which is illustrated in FIG. 7. Since a car's exterior is a plethora of changing compound curves the ability for the tool to mimic these geometric proportions based on the contour of the undamaged area surrounding the dent is what can dramatically shorten the time it takes a bodyman skilled with the tool to repair a vehicle. In use, a synthetic filler 28 is applied in excess to the damaged (dented) part 20 of a body panel. Precision contouring tool 6 is brought in contact with an undamaged portion of body panel 22, at an approximate angle of 20°-80° to body panel 22. A user then applies pressure, via his thumbs, at both the proximate and distal ends 12, 14 on first face 8 of tool 6 to match the contour of the undamaged portion of body panel 22. The user then slides tool 6 across dent 20. The tool 6 will remain in contact and match the contour of each side 24 and 26 of dent 20, and will transfer that contour as it presses synthetic filler 28 into the dent 20 and pushes excess synthetic filler 26 ahead of it. During the slide of the tool 6 the user increases or decreases the pressure that his thumbs exert to maintain planar contact with the contoured periphery of the dented area. This allows for smooth transitions between the different geometric contours of the area under repair. Full replication of a compound curved body panel with the tool 6 may be achieved due to the synergistic effect of the specific spring steel used, the specific PTFE tape used, and the tool's dimensions. The precision contouring tool can be used over and over again without suffering from metal fatigue or work hardening.

Figure 8:
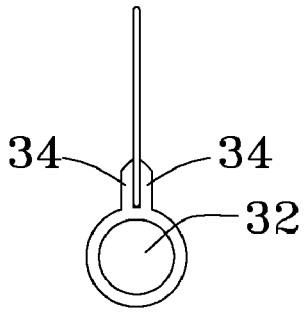
FIG. 8 is an end view of the precision contouring tool, featuring a stiffening bar.
Figure 9:
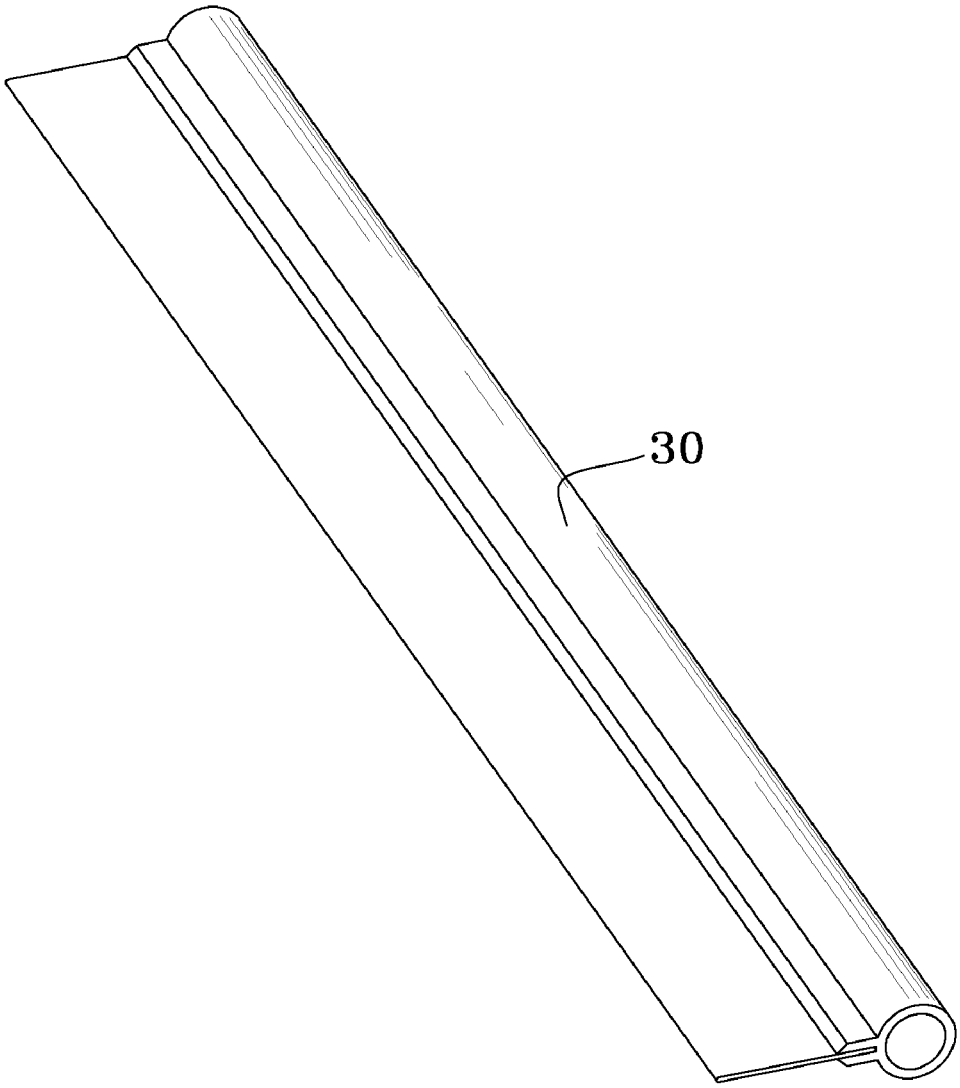
FIG. 9 is a perspective view of the precision contouring tool, featuring a stiffening bar.

For flat applications, i.e., where the body panel 22 is not contoured, a stiffening bar 30 can be added to tool 6 as is visible in FIGS. 8 and 9. Stiffening bar 30 is comprised of an inelastic material, preferably carbon fiber or extruded aluminum and simply holds tool 6 via a friction fit. Stiffening bar 30 is circular in cross-section with a round hollow interior cavity 32 with two beveled retention members 34, which form an inwardly tapered slot for frictional retention of tool 6. When tool 6 is frictionally affixed to stiffening bar 30, tool 6 remains rigid, and will not flex, allowing for the planar, smooth contouring and shaping of synthetic filler 28, as may be found on the center of a car trunk. Additionally, since beveled retention members 32 are beveled, tool 6 can be used with stiffening bar 30 at very acute angles without stiffening bar 30 contacting the body panel.

Looking at FIG. 10, the application of synthetic filler 28 to flat body panel 36 can be seen. Synthetic filler 28 is applied in excess to the damaged (dented) part 38 of flat body panel 36. Then, precision contouring tool 6 frictionally affixed to stiffening bar 30 is brought in contact with an undamaged portion of flat body panel 36, at an approximate angle between 20°-80° to flat body panel 36. A user then grips the proximate and distal ends 12, 14 of tool 6 and slides tool 6 across dent 38 without exerting any pressure from the thumbs to arc the tool 6. The tool 6 will remain in contact and match the flatness of each side 40 and 42 of dent 38, and will transfer that flatness as it presses synthetic filler 28 into the dent 38 and pushes excess synthetic filler 28 ahead of it. Dent 38 is now contoured and shaped. The repair is smooth and uniform, restoring the original shape of body panel 38.

After contouring and shaping of a synthetic filler to a damaged body panel often excess filler will remain on the precision contouring tool. After the synthetic filler dries it can be simply removed from the tool via a plastic scouring pad or blown clean via an air hose.

Making the tool 6 out of a carbon steel treated and sized as described above imparts a certain "feel" and "memory" for arcing the tool to mimic most of common arcs of its working range which lie in the 1/16 to 1 inch range as measured between the lower edge of the tool at the tool's longitudinal center and a plane drawn between the distal and proximate tool ends. This is learned quite quickly. The force required to arc the tool 6 beyond this range requires a considerable amount of thumb pressure. The amount of thumb pressure required to exceed the tool's working range makes the tool vibrate slightly (that the user can feel) and thus leaves a wavy trail of synthetic filler that is clearly visible and requires additional sanding. Thus, the specific dimensional configuration and mechanical properties of the preferred embodiment tool accomplish an unexpected synergist effect that allows the tool to be self limiting or at least able to give the user physical and visual clues that he is out of the working range. This is important as not all bodymen have the eyesight to be able to make the tool 6 conform the contours of the area surrounding the dent. Tool 6 actually sees or feels the contour.

A first alternate embodiment is a thinner version and therefore to achieve the same self limiting effect with the same steel, has the following dimensional properties (+/−5%): 0.05" thick, 2" wide, and 24" long. The first alternate embodiment is perfect for moderately cured areas such as quarter panels, liftgates, and, fenders, etc., where the working range is in the 1.25 inches to 2 inches range as measured between the lower edge of the tool at the tool's longitudinal center and a plane drawn between the distal and proximate tool ends.

A second alternate embodiment is yet an even thinner version than the first alternate embodiment with the following dimensional properties: (+/−5%): 0.042" thick, 2" wide, and 24" long and perfectly suited for the contouring of highly curved surface areas such as hoods, where the working range is in the greater than 2 inches range as measured between the lower edge of the tool at the tool's longitudinal center and a plane drawn between the distal and proximate tool ends.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

I claim:

1. A precision contouring tool comprising:

a generally planar linear member made of 0.062 inches +/−5% thick ASTM 1095 carbon steel having a first planar face, a parallel second planar face, a first edge, a second edge, a first end edge and a second end edge;

a unitary strip of 0.012 inches +/−2% thick polytetrafluoroethylene tape chemically affixed about the linear member so that the bottom edge and the upper edge are completely covered in said tape;

a linear stiffening bar with an inwardly tapered longitudinal slot formed therein that houses said linear member by frictional engagement along either of said edges.

2. The precision contouring tool of claim 1 wherein said linear member is 24 inches long and 2 inches wide.

3. The precision contouring tool of claim 2 wherein said slot is approximately 24 inches long.

4. The precision contouring tool of claim 3 wherein said polytetrafluoroethylene tape forms a seam along a longitudinal axis of said first planar face.

5. The precision contouring tool of claim 4 wherein said ASTM 1095 steel has been cold rolled, annealed, and blue tempered into a spring steel with a Rockwell hardness of HRC 48-51.

6. The precision contouring tool of claim 5 wherein said polytetrafluoroethylene tape has a silicone adhesive and an adhesive thickness of 0.0022 inches +/−2%, a tensile strength of 33 lbs/in +/−2%; and an elongation percent of 250%+/−2%.

7. A precision contouring tool comprising:

a generally planar linear member made of 0.062 inches +/−5% thick ASTM 1095 carbon steel having a first planar face, a parallel second planar face, a first edge, a second edge, a first end edge and a second end edge;

a unitary strip of 0.012 inches +/−2% thick polytetrafluoroethylene tape chemically affixed about the linear member so that the bottom edge and the upper edge are completely covered in said tape;

a linear stiffening bar with an inwardly tapered longitudinal slot formed therein that houses said linear member by frictional engagement along either of said edges; wherein said linear member is 24 inches long and 2 inches wide;

said slot is approximately 24 inches long; said polytetrafluoroethylene tape forms a seam along a longitudinal axis of said first planar face;

said ASTM 1095 steel has been cold rolled, annealed, and blue tempered into a spring steel with a Rockwell hardness of HRC 48-51;

wherein said polytetrafluoroethylene tape has a silicone adhesive and an adhesive thickness of 0.0022 inches +/−2%, a tensile strength of 33 lbs/in +/−2%; and an elongation percent of 250%+/−2%.

8. The precision contouring tool of claim 6 wherein said first edge, said second edge, said first end edge, and said second edge are radiused.

* * * * *